United States Patent [19]

Crandall et al.

[11] 4,399,340

[45] Aug. 16, 1983

[54] GUARD FOR A TRIGGER SWITCH

[75] Inventors: Norma M. Crandall; Raymond H. Doyle, both of Sidney; Walter F. Kunkler, Otego, all of N.Y.

[73] Assignee: The Bendix Corporation, Southfield, Mich.

[21] Appl. No.: 261,812

[22] Filed: May 8, 1981

[51] Int. Cl.[3] ..... H01H 9/20

[52] U.S. Cl. ..... 200/334; 200/157

[58] Field of Search ..... 200/157, 304, 321, 333, 200/334; 89/136, 27 A, 150

[56] References Cited

U.S. PATENT DOCUMENTS

| | | | |
|---|---|---|---|
| 2,348,393 | 5/1944 | Krieger | 200/334 |
| 2,712,272 | 7/1955 | Trevaskis et al. | 89/136 |
| 2,791,664 | 5/1957 | Rohacs | 200/157 |
| 3,142,227 | 7/1964 | Stringer | 89/136 |
| 3,170,050 | 2/1965 | Buturga | 200/42 T |
| 3,198,922 | 8/1965 | Rohacs | 200/157 |
| 4,276,459 | 6/1981 | Willett et al. | 200/157 |
| 4,363,944 | 12/1982 | Poirier | 200/334 |

*Primary Examiner*—Stephen Marcus
*Assistant Examiner*—Ernest G. Cusick
*Attorney, Agent, or Firm*—Raymond J. Eifler

[57] ABSTRACT

The invention is a trigger switch of the type having a pistol grip shaped housing (1) with a first trigger switch (10) mounted in the upward forward portion of the housing (1) and a second trigger switch (20) mounted immediately below said first trigger switch (10) and characterized by a trigger guard (30) which is pivotally mounted at the upward end thereof to said housing (1) so that the guard (30) may be moved from a first lower position that protects the second lower switch (20) from being operated to a second upper position that allows the second switch (20) to be operated and a member (60) fixedly mounted to the housing (1) adjacent to guard (30) and extending between the first and second positions of the guard (1) and including a boss (61) thereon that extends in the direction towards said guard (60) and is adapted to engage the guard (30) when the guard (30) is moved between the first and second positions. The boss (61) being sized to provide enough force between the member (60) and the guard (30) to prevent the guard (30) from returning to the first position, unless an operator of the trigger switch supplies additional force to the guard to return it to the first position.

4 Claims, 5 Drawing Figures

GUARD FOR A TRIGGER SWITCH

This invention relates to an aircraft control stick and more particularly to trigger switches mounted in the control stick and a safety device for guarding one of the switches.

Trigger switch type mechanism are fitted to the top of certain type of aircraft control sticks which may be pistol shaped to fit the pilot's hand. In some types of control sticks used in helicopters there are two switches, one above the other. The upper switch does not require a guard to prevent inadvertent operation of the switch. However, the lower switch actuates a firing mechanism and therefore requires a guard to prevent inadvertent operation. Examples of switches having guards may be found in U.S. Pat. Nos. 2,712,272 issued July 5, 1955 and entitled "Trigger Mechanism" and 2,348,393 issued May 9, 1944 and entitled "Guard for Electric Switch Levers". However, these guard designs do not permit continuous operation of one of the switches while moving the guard away from the other switch and then simultaneous operation of both switches.

DISCLOSURE OF THE INVENTION

This invention provides a guard for one of two trigger switches that does not require interrupting the operation of the other switch to move the guard.

The invention is a trigger switch of the type having a pistol grip shaped housing with a first trigger switch mounted in the upward forward portion of the housing and a second trigger switch mounted immediately below said first trigger switch and characterized by a trigger guard which is pivotally mounted at the upper end thereof to said housing so that the guard may be moved from a first lower position that protects the second switch from being operated to a second upper position that allows the second switch to be operated and a member fixedly mounted to the housing adjacent the guard and extending between the first and second positions of the guard and including a boss thereon that extends in the direction towards said guard and is adapted to engage the guard when the guard is moved between the first and second positions. The boss being sized to provide enough force between the member and the guard to prevent the guard from returning to the first position, unless the operator of the trigger switch supplies additional force to the guard.

One advantage of this invention is that the simple design of the guard allows an operator of the switch to move the guard with only one finger while still operating the other switch with another finger to obtain simultaneous operation of both switches.

Another advantage of this invention is that the trigger switches and guard may be operated with only one hand.

Another advantage of this invention is that the guard prevents accidental accuation of the lower switch which controls a firing mechanism.

DETAILED DESCRIPTION OF THE INVENTION

Figure 1:
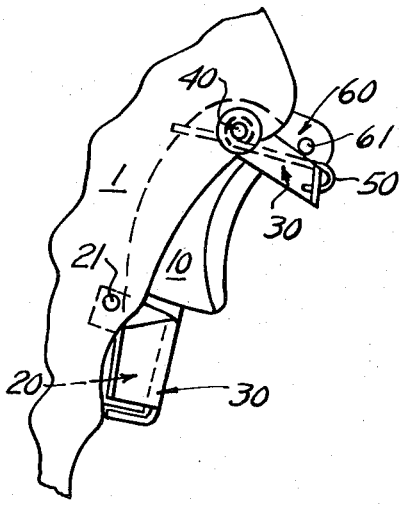
FIG. 1 illustrates a side view of an aircraft control stick which incorporates the principles of this invention.

Referring now to the drawings, FIG. 1 illustrates an aircraft control stick or trigger switch of the type having a pistol grip shaped housing 1; a first upper trigger switch 10 and a second lower trigger switch 20 pivotally mounted to the housing 1 by member 21. Protecting the lower switch 20 from being inadvertently operated is a trigger guard 30 which is pivotally mounted at one end to the housing 1 by rod shaped member 40. The trigger guard 30 is generally in the shape of an inverted "L". A spring 50 is wrapped around the rod shaped member 40 and over the trigger switch guard 30 to bias the guard 30 downwardly into a first position that protects the trigger switch 20 from being operated. Fixedly mounted to the housing 1 is a member 60 which includes a boss 61 extending in the direction towards said guard 30.

Figure 2:
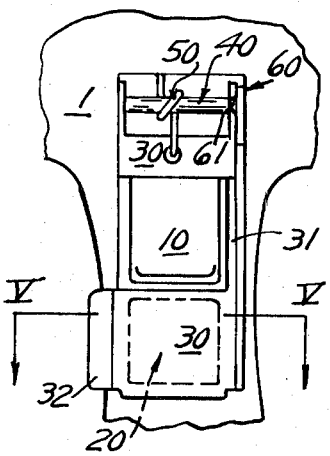
FIG. 2 illustrates a front view of the control stick shown in FIG. 1.
Figure 4:
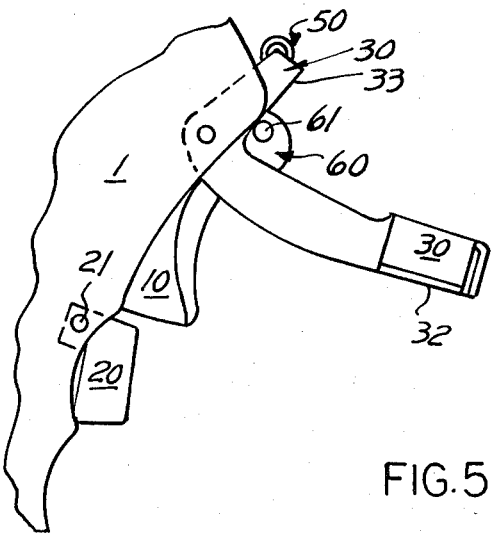
FIG. 4 illustrates the guard raised to a second upward position to permit operation of a lower firing switch.

FIG. 2 illustrates a front view of the trigger switch shown in FIG. 1. The trigger guard 30 includes an upper portion and a lower portion connected together by an elongated member 31 along one side of the upper switch 10 so that the guard 30 does not prevent operation of the upper switch 10. The guard 30 also includes a flange 32 which is adapted to be engaged by the middle finger of the aircraft operator who, by flipping his finger forward would flip the guard 30 upward to a second open position as shown in FIG. 4. This figure illustrates how the boss 61 on the fixedly mounted member 60 interferes with the movement of the guard 30 between the lower and upper positions.

Figure 3:
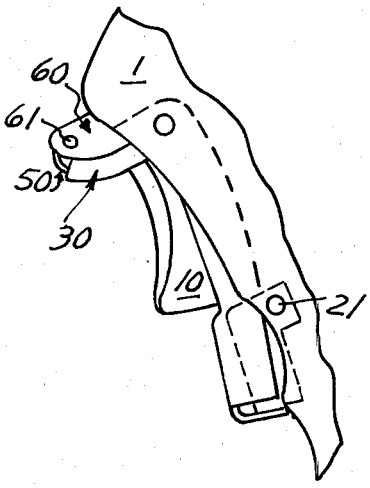
FIG. 3 illustrates an opposite side view of the control stick.

FIG. 3 illustrates the opposite side view of the trigger switch shown in FIG. 1.

FIG. 4 illustrates the trigger switch guard 30 in a raised position which permits operation of the lower trigger switch 20. In this position the boss 61 prevents the guard 30 from returning to its lower position because it engages the forward leading surface 33 of the upper portion of the guard 30. If the aircraft operator desires to return the trigger guard 30 to the lower position, which protects the trigger switch 20 from operation, he merely uses his finger to provide the additional force necessary to overcome the resistance between the boss 61 and the upper portion of the trigger guard 30.

Figure 5:
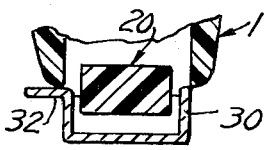
FIG. 5 is a cross sectional view of the lower switch and guard taken along lines V—V of FIG. 2.

FIG. 5 illustrates the cross sectional view of the housing 1, trigger switch 20 and the guard 30 taken along lines V—V of FIG.2. The trigger guard 30 includes a flange 32 which has two functions i.e. (1) it provides a contact point for the finger of the aircraft operator to raise the guard 30 and (2) it abuts against the housing 1 to prevent the guard 30 from being depressed into the trigger switch 20.

During operation of the aircraft an operator may operate the upper switch 10 (FIG. 1) with his forefinger. Should the operator wish to operate the lower switch 20, without interrupting the operation of the upper switch 10, he simply uses his middle finger on the same hand to engage the flange 32 and flip up the guard 30 into its raised position (FIG. 4) and then operates the lower switch 20 with his middle finger.

While a preferred embodiment of the invention has been disclosed, it will be apparent to those skilled in the art, that minor changes may be made to the invention as set forth in the appended claims and, in some instances, certain features of the invention may be used to advantage without corresponding use of other features. For instance the trigger guard 30 may or may not be biased by a spring mechanism 50, accordingly, it is intended the illustrative and descriptive materials herein be used to illustrate the principals of this invention and not to limit the scope thereof.

Having described the invention what is claimed is:

1. In combination with a trigger switch of the type having: a pistol grip shaped housing; a first trigger switch mounted in an upper forward part of the housing; a second trigger switch mounted immediately below said first trigger switch; a trigger guard for said second trigger switch; means for pivotally mounting said trigger guard at one end thereof to said housing above said first switch so that said guard may be moved from a first lower position that protects said second switch from being operated to a second upper position that allows said second switch to be operated; and means for biasing said guard towards said first position, the improvement comprising:

a member fixedly mounted to said housing adjacent said guard and extending between said first and second positions of said guard, said member including an integral projection thereon that extends in a direction towards said guard, said projection adapted to engage said guard when said guard is moved between said first and second positions, said projection being sized to provide enough force between said member and said guard, to prevent said biasing means from returning said guard to said first position unless additional force is supplied to said guard by an operator of said trigger switches.

2. The guard as recited in claim 1 including a flange along a portion of the side adjacent the end opposite of the end pivotally mounted to said housing, said flange adapted to engage said housing when said guard is in its first lower position whereby further movement of said guard towards said second switch is prevented.

3. In combination with a trigger switch of the type having: a pistol grip shaped housing; a first trigger switch mounted in an upper forward part of the housing; a second trigger switch mounted immediately below said first trigger switch; a trigger guard for said second trigger switch; means for pivotally mounting said trigger guard at one end thereof to said housing above said first switch so that said guard may be moved from a first lower position that protects said second switch from being operated to a second upper position that allows said second switch to be operated; the improvement comprising:

a member fixedly mounted to said housing adjacent said guard and extending between said first and second positions of said guard, said member including an integral projection thereon that extends in a direction towards said guard, said projection adapted to engage said guard when said guard is moved between said first and second positions, said projection being sized to provide enough force between said member and said guard, to prevent said guard from returning to said first position unless additional force is supplied to said guard by an operator of said trigger switches.

4. The guard as recited in claim 3 including a flange along a portion of the side adjacent the end opposite of the end pivotally mounted to said housing, said flange adapted to engage said housing when said guard is in its first lower position whereby further movement of said guard towards said second switch is prevented.

* * * * *